US007016468B1

(12) United States Patent
Krema et al.

(10) Patent No.: US 7,016,468 B1
(45) Date of Patent: Mar. 21, 2006

(54) X-RAY TUBE PREHEAT CONTROL

(75) Inventors: Alan P. Krema, Naperville, IL (US); John T. Griser, deceased, late of Streamwood, IL (US); by Virginia S. Griser, legal representative, Naperville, IL (US)

(73) Assignee: Progeny, Inc., Buffalo Grove, IL (US)

( * ) Notice: Subject to any disclaimer, the term of this patent is extended or adjusted under 35 U.S.C. 154(b) by 60 days.

(21) Appl. No.: 10/386,820

(22) Filed: Mar. 12, 2003

(51) Int. Cl.
*H05G 1/32* (2006.01)
*H05G 1/34* (2006.01)

(52) U.S. Cl. ..... 378/112; 378/101; 378/107; 378/111; 378/114

(58) Field of Classification Search ..... 378/38, 378/101, 105–112, 117, 118, 196, 197, 91, 378/114
See application file for complete search history.

(56) References Cited

U.S. PATENT DOCUMENTS 4,158,138 A * 6/1979 Hellstrom ..... 378/116
4,188,536 A * 2/1980 DallaPiazza ..... 378/109
4,191,889 A * 3/1980 Cowell ..... 378/109
4,346,297 A * 8/1982 Suzuki et al. ..... 378/110
4,443,843 A 4/1984 Ikeda et al.
4,596,029 A * 6/1986 Manueco Santurtun et al. . 378/105
D290,500 S 6/1987 Makas et al.
4,670,893 A * 6/1987 Tsuchiya ..... 378/105
4,775,992 A * 10/1988 Resnick et al. ..... 378/110
4,811,374 A * 3/1989 Kasa et al. ..... 378/96
4,831,642 A 5/1989 Chattin
4,851,983 A 7/1989 Chattin
4,868,462 A 9/1989 Chattin
4,930,146 A * 5/1990 Flakas et al. ..... 378/110
4,993,057 A 2/1991 Runnells
5,023,769 A * 6/1991 Beland ..... 363/86
5,067,143 A * 11/1991 Watanabe et al. ..... 378/110
5,200,984 A * 4/1993 Laeuffer ..... 378/110
5,272,618 A * 12/1993 Blake ..... 363/79
5,339,349 A * 8/1994 Xeno ..... 378/101
D387,163 S 12/1997 Osthues et al.
6,315,259 B1 11/2001 Kolb

* cited by examiner

*Primary Examiner*—Allen C. Ho
(74) *Attorney, Agent, or Firm*—Nicholas A. Kees; Godfrey & Kahn, S.C.

(57) ABSTRACT

A current feedback circuit in a dental imaging apparatus, which measures the x-ray tube current produced by the x-ray filament. During preheat, when the tube current is sensed to be appropriate for production of a constant rate of electrons, preheat is stopped, and diagnostic radiation emission begins. This circuit eliminates a fixed amount of preheat pulses which contribute unusable radiation during preheat of the filament in prior art systems.

14 Claims, 5 Drawing Sheets

X-RAY TUBE PREHEAT CONTROL

BACKGROUND OF THE INVENTION

The present invention relates to an x-ray imaging system, in particular, to a dental x-ray imaging system having x-ray tube preheat control circuitry for measuring the x-ray tube current and producing diagnostic radiation when the current is sensed to be appropriate for producing a constant rate of electrons.

A dental x-ray imaging system customarily has an x-ray tube enclosed in a housing called a tube head. One face of the tube head has an opening through which the primary x-ray beam is projected from the x-ray tube target toward the examination subject. A tubular member, called a cone, is coupled to the tube head axially of the opening to limit the x-ray beam to the proper area on the subject's intraoral region.

Some of the primary factors associated with diagnostic x-ray imaging apparatus include the peak voltage applied to the x-ray tube during exposure, the current forced through the x-ray tube in response to the selected peak voltage, and the time of duration of the exposure. The peak voltage determines the penetrating power of the x-ray beam, while the current determines the intensity of the beam.

Substantially all AC powered dental imaging systems have a preheat period, which allows the current flowing through the tube head filament to heat the filament before applying full voltage across the x-ray tube and permitting full current to flow through it. This stabilizes the electron beam emitted by the filament before the x-ray exposure technically begins. That is, prior to the filament reaching an appropriate temperature for producing usable diagnostic x-rays, a plurality of preheat pulses are produced by applying a reduced kilovoltage potential to the x-ray tube, resulting in a number of pulses of non-usable unstable radiation. Though the exposure technically has not yet begun, radiation is therefore being produced at a reduced kilovoltage peak level and is impacting the patient and the film. This preheat time is often much longer than it needs to be, to be sure the filament is indeed "preheated" (has sufficient current flow). Because the levels of this radiation are so low, it is an insignificant contributor to patient dose or image creation. However, this radiation was never a problem until digital imaging sensors became available. Being much more sensitive to radiation than film, digital sensors can become saturated from radiation from the dental x-ray machines due to the radiation provided during this preheat period, accumulated with the radiation during the exposure.

In order to solve the preheating or stabilization problem, prior art designs would either include a separate filament heating circuit to preheat the filament to the appropriate temperature, or provide a self-rectified intraoral x-ray tube design that applies a low level voltage across the x-ray tube for a fixed amount of time to produced the required filament temperature for creating a constant rate of electrons for producing diagnostically useful radiation.

This invention relates to improvements to the structures and methods described above, and to solutions to the problems not solved thereby.

SUMMARY OF THE INVENTION

The present invention provides an x-ray imaging system comprising an automatic x-ray tube preheat control which measures the x-ray tube current and automatically controls and shortens the preheat cycle. The x-ray imaging system preferably includes a control unit, an articulated arm assembly connected at one end to the control unit and a tube head connected to the opposite end of the arm assembly. The x-ray tube head includes an x-ray tube for generating x-rays and a high voltage circuit for supplying a high voltage to the x-ray tube. The x-ray tube includes an anode and an electron emitting cathode filament positioned inside an evacuated glass envelope. The high voltage circuit includes a high voltage transformer having a primary winding coupled to the input line voltage and a secondary winding coupled to the anode and cathode filament. A current sensing feedback circuit is coupled to the secondary winding of the high voltage transformer for sensing the tube current in the filament. The feedback circuit preferably includes an amplifier with a tube current input and an output coupled to an analog to digital converter. The output of the analog to digital converter is coupled to a software controlled microprocessor for controlling the preheat cycle of the filament through outputs of the microprocessor controlling the inputs to the high voltage transformer.

When a line voltage is applied to the high voltage transformer, voltages are applied to the x-ray tube anode and cathode filament. The filament will not emit electrons instantaneously when a voltage is applied. The filament needs to be preheated before a steady flow of electrons will be emitted. The tube current feedback circuit of the present invention automatically controls the preheat cycle of the filament by applying a low level of voltage to the filament until the current flowing through the filament is enough to generate a constant rate of electrons at the anode, and so that the anode in turn produces usable diagnostic x-rays.

Various other features, objects, and advantages of the present invention will be made apparent to those skilled in the art from the following detailed description, claims, and accompanying drawings.

DETAILED DESCRIPTION OF THE INVENTION

Figure 1:
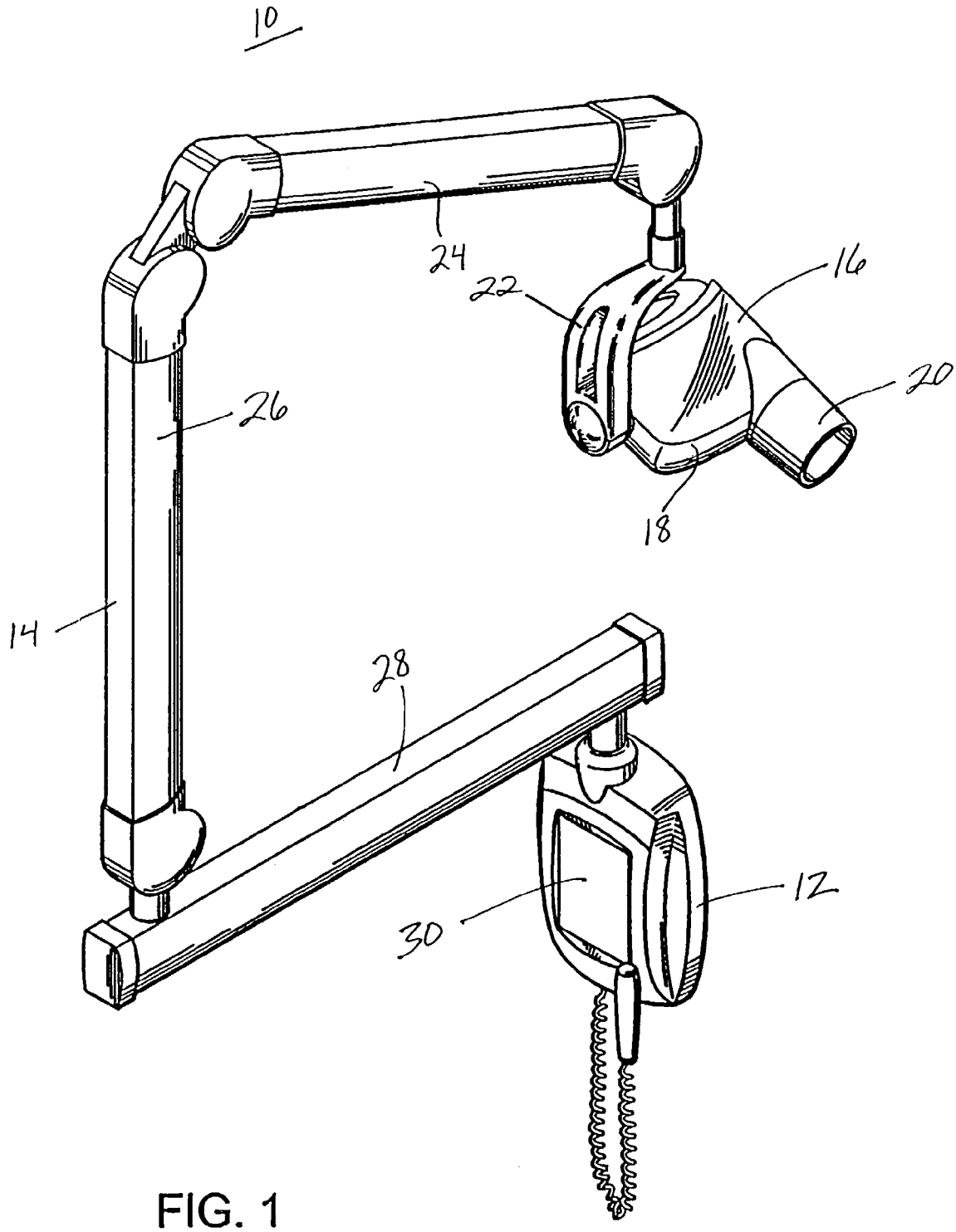
FIG. 1 is a perspective view of a dental x-ray tube head and a supporting arm mechanism of a dental x-ray imaging system constructed according to a preferred embodiment of the present invention.

As shown in FIG. 1, a dental x-ray imaging system 10 includes a wall unit 12 as a source of power, an articulated arm assembly 14 connected at one end to the wall unit, and a tube head 16 connected to the opposite end of the arm assembly. The dental x-ray tube head 16 includes a tube end wall 18 to which a tubular assembly 20, also known as a cone, is attached or formed integrally therewith. The tube head 16 is connected to the end of the arm assembly 14 by a yoke 22 which allows the head to rotate about a first axis at the point where the yoke attaches to the head, while at the same time permitting rotation of the head about a second, transverse axis at the point where the yoke attaches to the arm. Yoke 22 is pivotably mounted to a first end of a first arm segment 24 of articulated arm assembly 14, which in turn is pivotably connected at its opposite end to a second arm segment 26. The latter is mounted for rotation about a vertical axis on the distal end of a horizontally swingable arm segment 28, which in turn rotates about a vertical axis at its proximal end at the wall unit 12. The wall unit 12 preferably contains the x-ray tube controller and keypad 30 for programming the apparatus. This controller and keypad 30 may be mounted on a wall in the examination room in proximity with the chair on which the examination subject rests. It will be apparent that the articulated arm assembly 14 for the tube head 16 which has just been described may take many different forms and still enable the tube head 10 to be advanced, retracted and positioned as desired relative to the examination subject. The functional features of the tube support in general, including the articulated arm assembly 14, are essentially conventional.

Figure 2:
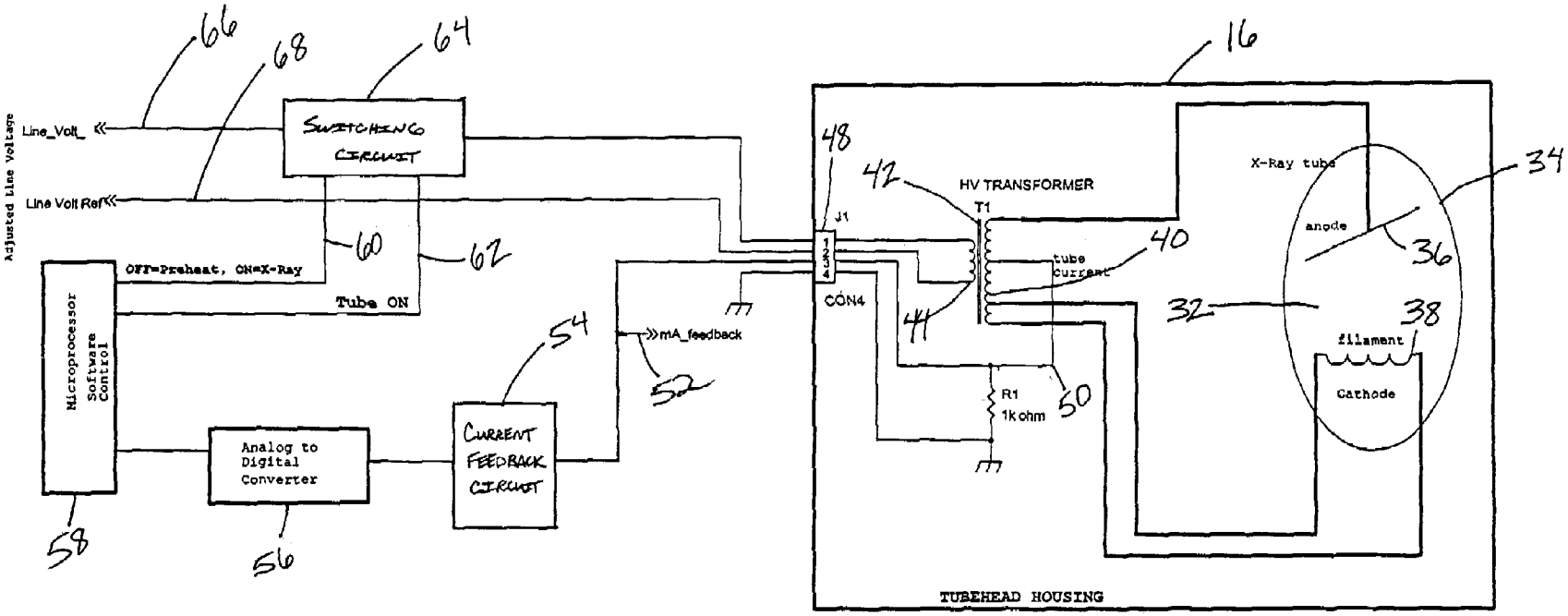
FIG. 2 is a schematic diagram of the electrical circuitry and electrical components of the dental imaging system shown in FIG. 1.

FIG. 2 is a schematic diagram of the electrical circuitry and electrical components of the dental imaging system of the present invention. The x-ray tube head 16 includes an x-ray tube 32 comprising a glass envelope 34, with an anode or target 36 and an electron emitting filament 38 positioned inside the glass envelope. The filament 38 is heated with current delivered from a high voltage transformer secondary winding 40 relative to a core 42 and a primary winding 44. The primary winding 44 of the high voltage transformer 42 is connected to the high voltage line 66. The secondary winding 40 of the high voltage transformer 42 is connected to the anode target 36 and the cathode filament 38 of the x-ray tube. The primary winding 44 is fed from the line voltage input 66 and the line voltage reference 68, through a connector 48, which leads extend back through the articulated arm assembly 14 to the controller and keypad 30 (FIG. 1). High voltage is therefore applied between anode 36 and electron emitting filament 38 from the secondary winding 40.

A lead 50 extending from an intermediate point on the secondary winding 40 passes through the connector 48 and connects to a current feedback circuit 54 for measuring the tube current. The lead 50 is also connected through a resistor R1 to ground. A feedback current lead 52 (mA feedback signal) extends from the connector 48 to the input of the current feedback circuit 54 which converts the mA feedback signal 52 to a usable level. The output of the current feedback circuit 54 is connected to an analog-to-digital converter 56 to convert the analog input signal to a digital output. The output of the analog-to-digital converter 56 is connected to a software-controlled microprocessor 58. A pair of outputs 60, 62 from the microprocessor 58 are connected to a switching circuit 64 coupled to the line voltage input 66 to control the line voltage 66 going to the high voltage transformer 42.

The current feedback circuit 54 measures the x-ray tube current produced by the x-ray tube cathode filament 38 emitting electrons. When the tube current is sensed to be appropriate for the production of a constant rate of electrons, the preheat process of preheating the filament with an applied voltage is stopped and full diagnostic emission begins. This eliminates a fixed amount of preheat pulses which contribute unusable radiation during preheating of the filament.

Figure 3:
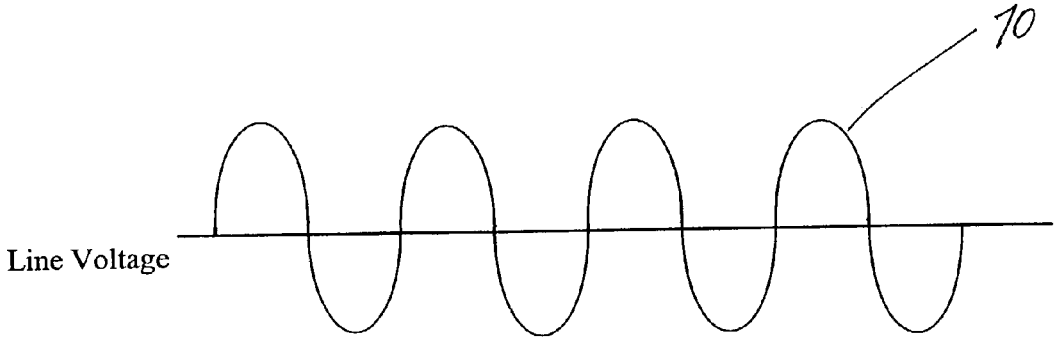
FIG. 3 is a signal drawing of the typical line voltage applied to the dental imaging system of the present invention.
Figure 4:
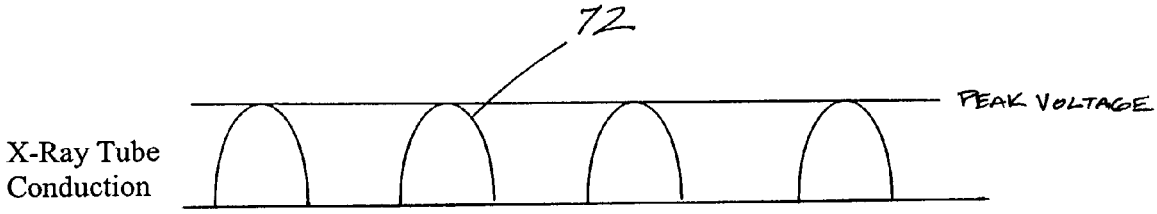
FIG. 4 is a signal drawing of the peak voltage applied to the x-ray tube of the present invention.

Referring now to FIGS. 3 and 4, the dental x-ray imaging system of the present invention uses x-ray tube control commonly known as x-ray tube self-rectification. This means that when an AC line voltage 70 is applied to the x-ray tube via a high voltage transformer, the x-ray tube, by its mechanical structure will conduct when the voltage is more positive on the anode than the cathode of the x-ray tube. Thus, the tube will conduct for each positive half cycle of line voltage applied to a peak voltage 72, as shown in FIG. 4.

An AC voltage of a predetermined level is applied to the high voltage line 66 and in turn high voltage transformer 42 to produce a tube voltage of a predetermined level between the anode target 36 of the x-ray tube 32 and the cathode filament 38. A filament tube current of a predetermined level flows through the filament to heat the filament. The filament 38 will not emit electrons instantaneously when voltage is applied. The filament 38, and thus the x-ray tube 32, will only emit when the filament reaches a predetermined temperature, which causes electrons to be emitted from the filament. The filament 38 heats up as the current passes through due to the applied voltage. After the filament 38 reaches the critical temperature, a steady flow of electrons will be emitted from the filament toward the anode 36. The electrons accelerate across the x-ray tube to the anode 36, their impact thereon causing the emission of heat and x-rays. For a period within a predetermined exposure period in which the potential of the anode target 36 is made positive by the self-rectifying function of the x-ray tube 32, a tube current of a predetermined level flows, and x-rays are generated from the anode target 36. The amount of electrons flowing through the x-ray tube constitutes the tube current, measured in milliamperes (mA).

For the radiation produced to be radiographically useful, it must be produced in an amount that is at a constant rate and in a proportional amount per time. For this reason, the filament 38 must be able to produce a constant rate of electrons when diagnostic radiation is being recorded. In order to achieve the appropriate filament temperature without a separate filament heating circuit, the filament can only be heated when voltage is applied to the x-ray tube. Most self rectified intraoral dental radiographic designs which do not apply a separate filament heating circuit apply a low level of voltage across the x-ray tube 32 for a fixed amount of time to produce the required filament temperature. The radiation produced is not diagnostically useful, but does contribute to the total dose administered. This preheat radiation also is absorbed by the image receptor. In the case of modern solid state image sensors, the sensitivity is greater than traditional film, and this radiation contributes to noise while not providing a useable signal.

Figure 5:
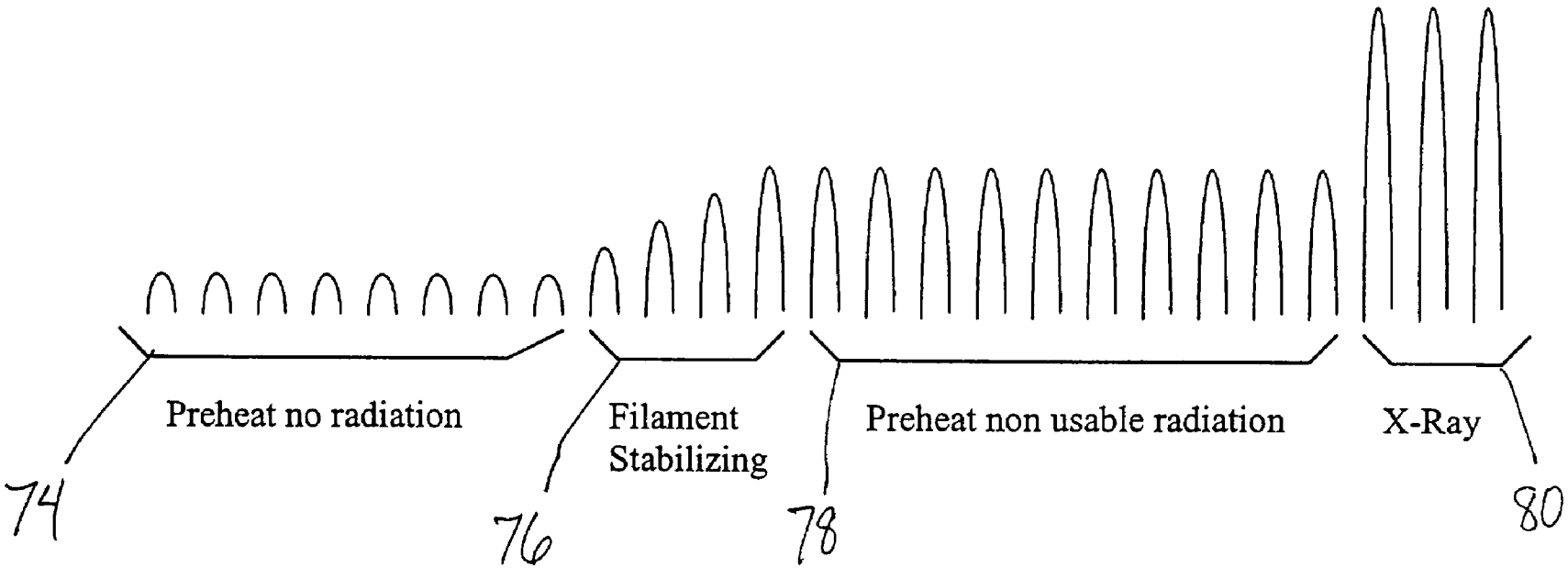
FIG. 5 PRIOR ART
FIG. 5 is a diagram showing output characteristics of a x-ray tube of a prior art dental imaging system.

FIG. 5 illustrates the radiation output characteristics of a conventional dental imaging system utilizing a self-rectified intraoral x-ray tube design. This prior art design provides a fixed amount of preheat time, at low peak voltage levels, then applies a voltage to produce the peak voltage required for diagnostically useful radiation. Before the filament reaches the predetermined temperature during preheat, there is no radiation produced, since no electrons are emitted from the filament. Thus, the first preheat pulses 74 do not produce radiation. There is a filament-stabilizing period 76 just before the filament reaches the predetermined temperature. When the filament reaches that temperature, the remaining preheat pulses 78 are producing non-usable unstable radiation. Finally, the electron emissions from the filament stabilize, and the filament produces a constant rate of electrons and diagnostic x-rays are produced 80.

Figure 6:
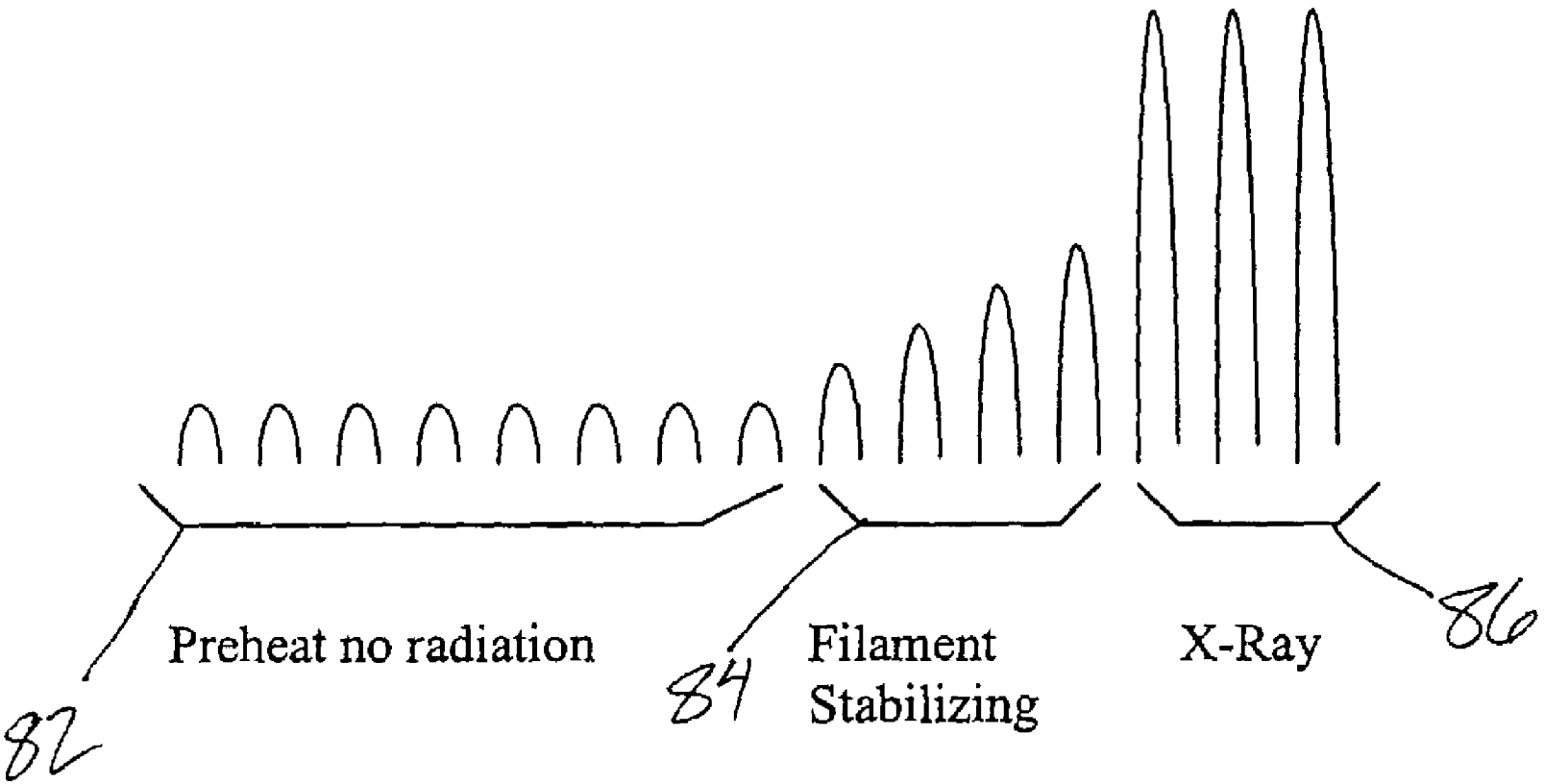
FIG. 6 is a diagram showing output characteristics of the x-ray tube of the present invention.

Referring now to FIG. 6, the present invention provides a feedback circuit, which measures the x-ray tube current produced by the filament emitting electrons. During preheat, the first preheat pulses 82 do not produce radiation. There is also a filament stabilizing period 84 just before the filament reaches temperature. When the tube current is sensed to be appropriate for production of a constant rate of electrons, the preheat is stopped and full diagnostic radiation emission begins 86. This eliminates a fixed amount of preheat pulses 78 which contribute unusable radiation during preheat of the filament. For the prior art system shown in FIG. 5, there are 22 preheat pulses, while for the present invention, there are only 12 preheat pulses.

While the invention has been described with reference to preferred embodiments, it is to be understood that the invention is not intended to be limited to the specific embodiments set forth above. It is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

We claim:

1. An x-ray imaging system comprising:

a tube head connected to a control unit by means of an articulated arm, said tube head including a housing;

an x-ray tube mounted within the housing for generating x-rays, wherein the x-ray tube includes an anode and an electron emitting cathode filament;

a high voltage circuit for supplying an AC voltage from at least two input line voltage power lines to the x-ray tube, wherein the high voltage circuit includes a high voltage transformer having a primary winding coupled to the input line voltage and a secondary winding coupled to the anode and cathode filament of the x-ray tube; and an x-ray tube preheat control circuit coupled between the x-ray tube and the input line voltage power lines for measuring x-ray tube current and controlling operation of the x-ray tube, wherein the x-ray tube preheat control circuit includes a current feedback circuit coupled to and receiving an input from the secondary winding of the high voltage transformer for sensing current in the filament, an analog to digital converter coupled to and receiving an output from the current feedback circuit for converting the output from the current feedback circuit to a digital signal, a microprocessor coupled to the analog to digital converter, and a switching circuit coupled to the input line voltage power lines and the microprocessor for adjusting the AC voltage applied to the high voltage transformer and switching the x-ray tube between a preheat condition and an x-ray radiation emission condition.

2. The x-ray imaging system of claim 1, wherein switching the x-ray tube between a preheat condition and an x-ray radiation emission condition occurs when the tube current is sensed to be appropriate for producing a constant rate of electrons.

3. The x-ray imaging system of claim 1, wherein the microprocessor is software controlled.

4. The x-ray imaging system of claim 1, wherein the x-ray tube receives an AC voltage from the high voltage transformer.

5. An x-ray imaging system comprising:

a tube head connected to a control unit by means of an articulated arm, said tube head including a housing;

an x-ray tube mounted within the housing for generating x-rays, wherein the x-ray tube includes an anode and an electron emitting cathode filament;

a high voltage circuit for supplying a high voltage from at least two input line voltage power lines to the x-ray tube, wherein the high voltage circuit includes a high voltage transformer having a primary winding coupled to the input line voltage and a secondary winding coupled to the anode and cathode filament of the x-ray tube; and an x-ray tube preheat control circuit coupled between the x-ray tube and the input line voltage power lines for measuring x-ray tube current and controlling operation of the x-ray tube, wherein the x-ray tube preheat control circuit includes a current feedback circuit for sensing the tube current in the filament, the current feedback circuit coupled between the high voltage transformer and an analog to digital converter, wherein the output of the analog to digital converter is coupled to a microprocessor for controlling the preheat cycle of the filament by controlling the inputs to the high voltage transformer, wherein the current feedback circuit receives an input from the secondary winding of the high voltage transformer and provides an output to the analog to digital converter.

6. An x-ray imaging system comprising:

a tube head connected to a control unit by means of an articulated arm, said tube head including a housing;

an x-ray tube mounted within the housing for generating x-rays, wherein the x-ray tube includes an anode and an electron emitting cathode filament;

a high voltage circuit for supplying a high voltage from at least two input line voltage power lines to the x-ray tube, wherein the high voltage circuit includes a high voltage transformer having a primary winding coupled to the input line voltage and a secondary winding coupled to the anode and cathode filament of the x-ray tube; and an x-ray tube preheat control circuit coupled between the x-ray tube and the input line voltage power lines for measuring x-ray tube current and controlling operation of the x-ray tube, wherein the x-ray tube preheat control circuit includes a current feedback circuit for sensing the tube current in the filament, the current feedback circuit coupled between the high voltage transformer and an analog to digital converter, wherein the output of the analog to digital converter is coupled to a microprocessor for controlling the preheat cycle of the filament by controlling the inputs to the high voltage transformer, wherein the current feedback circuit receives an input from the secondary winding of the high voltage transformer and provides an output to the analog to digital converter, and wherein the current feedback circuit includes an amplifier with a tube current input and an output coupled to the analog to digital converter.

7. A dental x-ray imaging system comprising:

a tube head including a housing;

an x-ray tube mounted in the housing for generating x-rays, wherein the x-ray tube includes an anode and an electron emitting cathode filament coupled to a high voltage transformer circuit for supplying an AC voltage to the x-ray tube, wherein the high voltage transformer circuit includes a high voltage transformer having a primary winding coupled to an input line voltage and a secondary winding coupled to the anode and cathode filament of the x-ray tube; and an automatic x-ray tube preheat control circuit coupled to the x-ray tube for measuring the x-ray tube current and controlling operation of the x-ray tube, wherein the x-ray tube preheat control circuit includes a current sensing feedback circuit coupled to and receiving an input from the secondary winding of the high voltage transformer for sensing the tube current in the filament, an analog to digital converter coupled to and receiving an output from the current feedback circuit for converting the output from the current feedback circuit to a digital signal, a microprocessor coupled to the analog to digital converter, and a switching circuit coupled to the input line voltage and the microprocessor for adjusting the AC voltage applied to the high voltage transformer and switching the x-ray tube between a preheat condition and an x-ray radiation emission condition.

8. The dental x-ray imaging system of claim 7, wherein switching the x-ray tube between a preheat condition and an x-ray radiation emission condition occurs when the tube current is sensed to be appropriate for producing a constant rate of electrons.

9. The x-ray imaging system of claim 7, wherein the x-ray tube receives an AC voltage from the high voltage transformer.

10. A dental x-ray imaging system comprising:

a tube head including a housing;

an x-ray tube mounted in the housing for generating x-rays, wherein the x-ray tube includes an anode and an electron emitting cathode filament coupled to a high voltage transformer circuit for supplying a high voltage to the x-ray tube, wherein the high voltage transformer circuit includes a high voltage transformer having a primary winding coupled to an input line voltage and a secondary winding coupled to the anode and cathode filament of the x-ray tube; and an automatic x-ray tube preheat control circuit coupled to the x-ray tube for measuring the x-ray tube current and controlling operation of the x-ray tube, wherein the x-ray tube preheat control circuit includes a current sensing feedback circuit for sensing the tube current in the filament coupled between the high voltage transformer and an analog to digital converter, wherein the output of the analog to digital converter is coupled to a microprocessor for controlling the preheat cycle of the filament by controlling the inputs to the high voltage transformer, wherein the current sensing feedback circuit receives an input from the secondary winding of the high voltage transformer and provides an output to the analog to digital converter.

11. A dental x-ray imaging system comprising:

a tube head including a housing;

an x-ray tube mounted in the housing for generating x-rays, wherein the x-ray tube includes an anode and an electron emitting cathode filament coupled to a high voltage transformer circuit for supplying a high voltage to the x-ray tube, wherein the high voltage transformer circuit includes a high voltage transformer having a primary winding coupled to an input line voltage and a secondary winding coupled to the anode and cathode filament of the x-ray tube; and an automatic x-ray tube preheat control circuit coupled to the x-ray tube for measuring the x-ray tube current and controlling operation of the x-ray tube, wherein the x-ray tube preheat control circuit includes a current sensing feedback circuit for sensing the tube current in the filament coupled between the high voltage transformer and an analog to digital converter, wherein the output of the analog to digital converter is coupled to a microprocessor for controlling the preheat cycle of the filament by controlling the inputs to the high voltage transformer, wherein the current sensing feedback circuit receives an input from the secondary winding of the high voltage transformer and provides an output to the analog to digital converter, and wherein the current sensing feedback circuit includes an amplifier with a tube current input and an output coupled to the analog to digital converter.

12. In a dental x-ray tube head comprising a housing having an x-ray tube mounted therein, the improvement comprising:

an automatic x-ray tube preheat control circuit coupled to the x-ray tube for measuring x-ray tube current and controlling operation of a preheat cycle for preheating the x-ray tube filament, wherein the x-ray tube preheat control circuit includes a current feedback circuit coupled to and receiving an input from a secondary winding of a high voltage transformer for sensing current in the filament, an analog to digital converter coupled to and receiving an output from the current feedback circuit for converting the output from the current feedback circuit to a digital signal, a microprocessor coupled to the analog to digital converter, and a switching circuit coupled to an input line voltage power line and the microprocessor for adjusting the input line voltage applied to the high voltage transformer and switching the x-ray tube between a preheat condition and an x-ray radiation emission condition.

13. The dental x-ray tube head of claim 12, wherein switching the x-ray tube between a preheat condition and an x-ray radiation emission condition occurs when the tube current is sensed to be appropriate for producing a constant rate of electrons.

14. An x-ray imaging system comprising:

a tube head including a housing;

an x-ray tube mounted in the housing for generating x-rays, wherein the x-ray tube includes an anode and an electron emitting cathode filament;

a high voltage transformer for supplying an AC voltage to the x-ray tube, wherein the high voltage transformer includes a primary winding coupled to an input line voltage and a secondary winding coupled to the anode and cathode filament of the x-ray tube; and an x-ray tube filament drive circuit coupled to the high voltage transformer, wherein the x-ray tube filament drive circuit includes a current feedback circuit coupled to and receiving an input from the secondary winding of the high voltage transformer for sensing current in the filament, an analog to digital converter coupled to and receiving an output from the current feedback circuit for converting the output from the current feedback circuit to a digital signal, a microprocessor coupled to the analog to digital converter, and a switching circuit coupled to the input line voltage and the microprocessor for adjusting the AC voltage applied to the high voltage transformer and switching the x-ray tube between a preheat condition and an x-ray radiation emission condition.

* * * * *